US007640709B2

(12) United States Patent
Rawlings

(10) Patent No.: US 7,640,709 B2
(45) Date of Patent: Jan. 5, 2010

(54) INSULATED FRAME MEMBER

(75) Inventor: David Rawlings, Bishops Cleeve (GB)

(73) Assignee: Architectural & Metal Systems, Limited (IE)

( * ) Notice: Subject to any disclaimer, the term of this patent is extended or adjusted under 35 U.S.C. 154(b) by 352 days.

(21) Appl. No.: 11/182,637

(22) Filed: Jul. 15, 2005

(65) Prior Publication Data

US 2006/0018095 A1 Jan. 26, 2006

(30) Foreign Application Priority Data

Jul. 20, 2004 (IE) ..... 2004/0489

(51) Int. Cl.
*E04C 2/38* (2006.01)

(52) U.S. Cl. ..... 52/717.02; 52/586.1; 52/786.13

(58) Field of Classification Search ..... 52/712.02, 52/730.3–730.5, 731.3, 732.2, 212, 586.1–586.2, 52/656.5, 656.6, 786.13, 656.4; D25/122, D25/124

See application file for complete search history.

(56) References Cited

U.S. PATENT DOCUMENTS

| | | | | | |
|---|---|---|---|---|---|
| 2,901,904 | A * | 9/1959 | Wey | 52/396.03 |
| 3,363,383 | A * | 1/1968 | La Barge | 52/471 |
| 3,818,666 | A | 6/1974 | Winans | |
| 3,832,818 | A * | 9/1974 | Nahr | 52/730.5 |
| 3,878,660 | A * | 4/1975 | Jacob | 52/573.1 |
| 4,096,678 | A * | 6/1978 | Diels et al. | 52/396.05 |
| 4,330,919 | A * | 5/1982 | Bischlipp et al. | 29/418 |
| 4,492,063 | A * | 1/1985 | Schock et al. | 52/309.7 |
| 4,542,614 | A * | 9/1985 | Malachowski | 52/282.3 |
| 4,688,366 | A * | 8/1987 | Schmidt | 52/717.02 |
| 5,216,810 | A * | 6/1993 | Kendall | 29/897.312 |
| 5,544,457 | A * | 8/1996 | Labrecque | 52/204.69 |
| 5,727,356 | A * | 3/1998 | Ensinger et al. | 52/717.02 |
| 6,018,925 | A * | 2/2000 | Biro | 52/731.1 |
| D424,710 | S * | 5/2000 | Hersh et al. | D25/122 |
| 6,088,967 | A * | 7/2000 | Johnson | 52/28 |
| 7,293,391 | B2 * | 11/2007 | Guhl et al. | 52/204.593 |
| 2005/0115183 | A1 * | 6/2005 | Rawlings | 52/578 |

FOREIGN PATENT DOCUMENTS

| | | |
|---|---|---|
| DE | 1659428 | 1/1971 |
| EP | 0104574 | 4/1984 |
| EP | 0838571 | 9/1997 |
| WO | WO 3/069105 | 8/2003 |

* cited by examiner

*Primary Examiner*—Richard E. Chilcot, Jr.
*Assistant Examiner*—Chi Q Nguyen
(74) *Attorney, Agent, or Firm*—Skinner and Associates

(57) ABSTRACT

An insulated frame member 10 comprising first and second frame components 12, 14 interconnected by first and second thermally insulating connectors 24, 26 each connector 24, 26 defining, with the first and second frame components 12, 14 a channel 28, 30 containing a resin material 32, the connectors 24, 26 being off-set from one another.

6 Claims, 3 Drawing Sheets

INSULATED FRAME MEMBER

This invention relates to a frame member suitable for use in the formation of, for example, door or window frames. In particular, the invention relates to a frame member incorporating a thermal break to enhance the thermal insulating properties of the frame member.

It is known to produce insulated frame members from an extruded material shaped to define a channel by pouring a suitable resin into the channel, allowing the resin to cure and then removing the material from the base of the channel, for example by milling such that the final product has the appearance of two separate extruded members interconnected by the resin. In order to meet current thermal insulating regulations, the thermal break has to be fairly wide and problems have been experienced in trying to remove the necessary width of material from the extrusion in an economic manner.

Another known technique involves taking two separate frame components, interconnecting them using a thermally insulating connector and then applying a resin material to a channel defined by the two frame components and the connector. It is an object of the invention to provide enhancements to such a technique.

According to one aspect of the invention there is provided an insulated frame member comprising first and second frame components interconnected by first and second thermally insulating connectors, each connector defining, with the first and second frame components, a channel containing a resin material, the connectors being off-set from one another.

The provision of offset thermal breaks allows for greater freedom in the design of window and door frames. Such off-setting could not be achieved with prior arrangements.

Conveniently the connectors are push-fitted to the frame components. Such an arrangement allows for a degree of movement to occur between the frame components and the connectors accommodating, for example, shrinkage of the resin which may occur during curing.

The connectors conveniently include hollow regions. Such arrangements are advantageous in that the thermal insulating properties of the connectors may be enhanced. Further, the cost and weight of the connectors can be reduced. Conveniently the connectors include connector regions adapted to be push-fitted into corresponding recesses formed in the frame components, the connector regions being hollow and defining locations into which screws can be secured. The use of the connector regions in this manner means that separate screw locations do not need to be provided on the frame components. The use of the hollows in the connector regions ensures that the integrity of the thermal break is not impaired.

The invention also relates to a connector suitable for use in an insulated frame member and comprising a pair of projections adapted to be push-fitted into corresponding formations provided on respective frame components, at least one of the projections being hollow and defining a location into which a screw can be secured.

The invention will further be described, by way of example, with reference to the accompanying drawings, in which.

Figure 1:
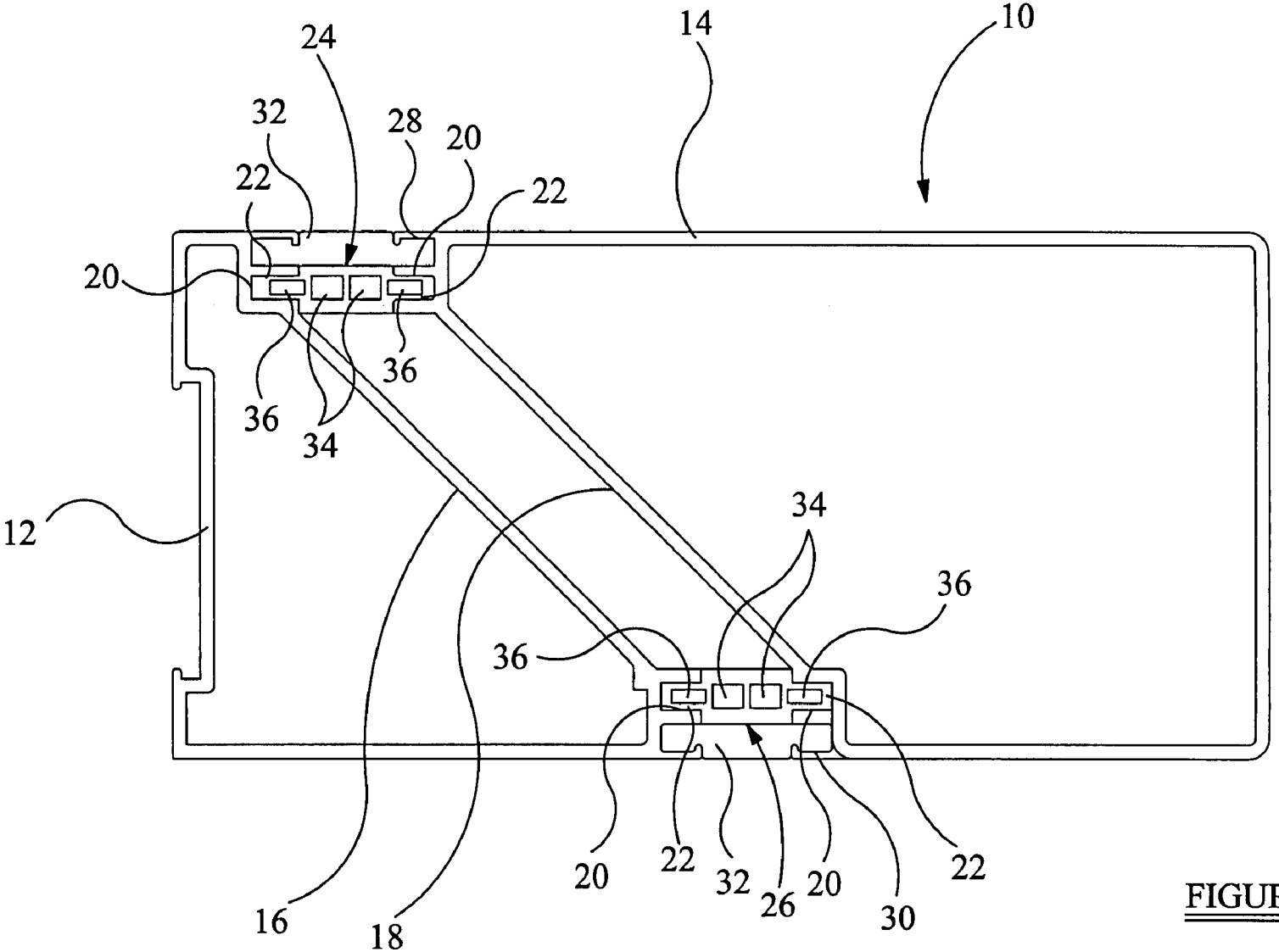
FIG. 1 is a sectional view illustrating part of a frame member in accordance with an embodiment of the invention.
Figure 2:
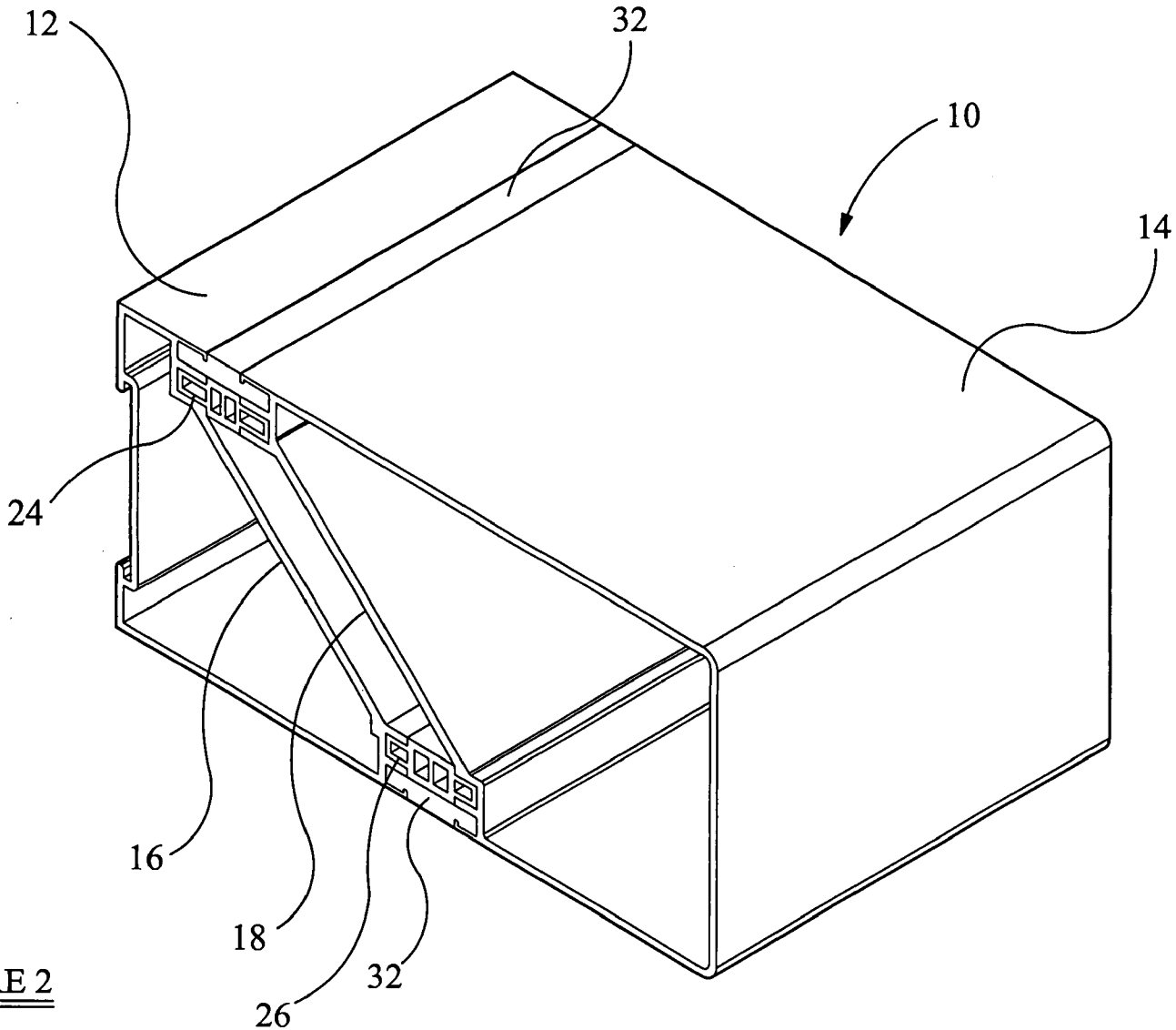
FIG. 2 is a perspective view of part of the frame member of FIG. 1.

Referring firstly to FIGS. 1 and 2 there is shown a frame member 10 which comprises a first extruded aluminium frame component 12 which is secured to a second extruded aluminium frame component 14. The first and second frame components 12, 14, when assembled to one another define a frame member of generally rectangular cross-section intended for use in the manufacture of an aluminium window or door frame. Each of the frame components 12, 14 includes an angled wall 16, 18. The walls 16, 18 being arranged to extend generally parallel to one another in the assembled frame member 10 but to be angled to the front and side walls of the frame member. The frame components 12, 14 are also shaped to define channels 20, each channel 20 of the first frame components 12 lying opposite a corresponding one of the channels 20 of the second frame component.

The channels 20 of the first and second frame components 12, 14 are dimensioned to receive connector regions 22 of first and second connectors 24, 26. The fit of the connector regions 22 in the channels 20 is such as to allow the connectors 24, 26 to be push-fitted or press-fitted to the first and second frame components 12, 14, during the assembly of the frame member 10.

Each of the connectors 24, 26 defines, with the adjacent parts of the first and second frame components 12, 14, a respective channel 28, 30 which is filled with a suitable resin material 32, the resin material 32, when cured, serving to permanently lock the first and second frame components 12, 14 to one another, the resin material 32 in combination with the connectors 24, 26 forming a thermal break between the first and second frame components 12, 14.

The assembly process used in the formation of the frame member 10 involves push-fitting the connectors 24, 26 to the first and second frame components 12, 14. This is conveniently undertaken in a suitable jig, but it will be appreciated that other approaches may be taken to assemble the first and second frame components 12, 14 and first and second connectors 24, 26. Once the first and second frame components 12, 14 have been secured to one another using the connectors 24, 26, a suitable resin material is poured into the channel 28 defined, in part, by the first frame component 24. Once the resin material 32 in the channel 28 has cured, the frame component 10 is inverted to expose the channel 30. After such inversion, resin material 32 is poured into the channel 30 and allowed to cure. Unlike the prior art technique for use in the formation of a thermal break in a frame member, there is no step of milling, grinding or otherwise removing a bridge region inter-connecting the first and second frame components.

As the first and second frame components 12, 14 include angled walls 16, 18 which are arranged to face one another it will be appreciated that the first and second connectors 24, 26 and associated regions filled with resin material 32 are offset relative to one another. Such offsetting allows a much greater freedom in the design of the frame member. For example, in the arrangement illustrated in FIGS. 1 and 2, one of the thermally insulated inter-connections between the first and second frame components 12, 14 is located approximately midway along the width of the frame member 10, the other inter-connection being located close to one edge of the frame member 10. Prior art techniques for providing a thermal break in the frame member do not permit this.

The first and second connectors 24, 26 conveniently take the form of a strip of an extruded plastics material. The connectors 24, 26 are conveniently shaped to include hollow regions 34. The provision of such hollow regions 34 is advantageous in that it reduces the quantity of material included in the connectors 24, 26, consequently reducing the weight and cost of the connectors 24, 26. Additionally, the provision of the hollow regions 34 advantageously improves the thermal insulating properties of the connectors 24, 26.

Figure 3:
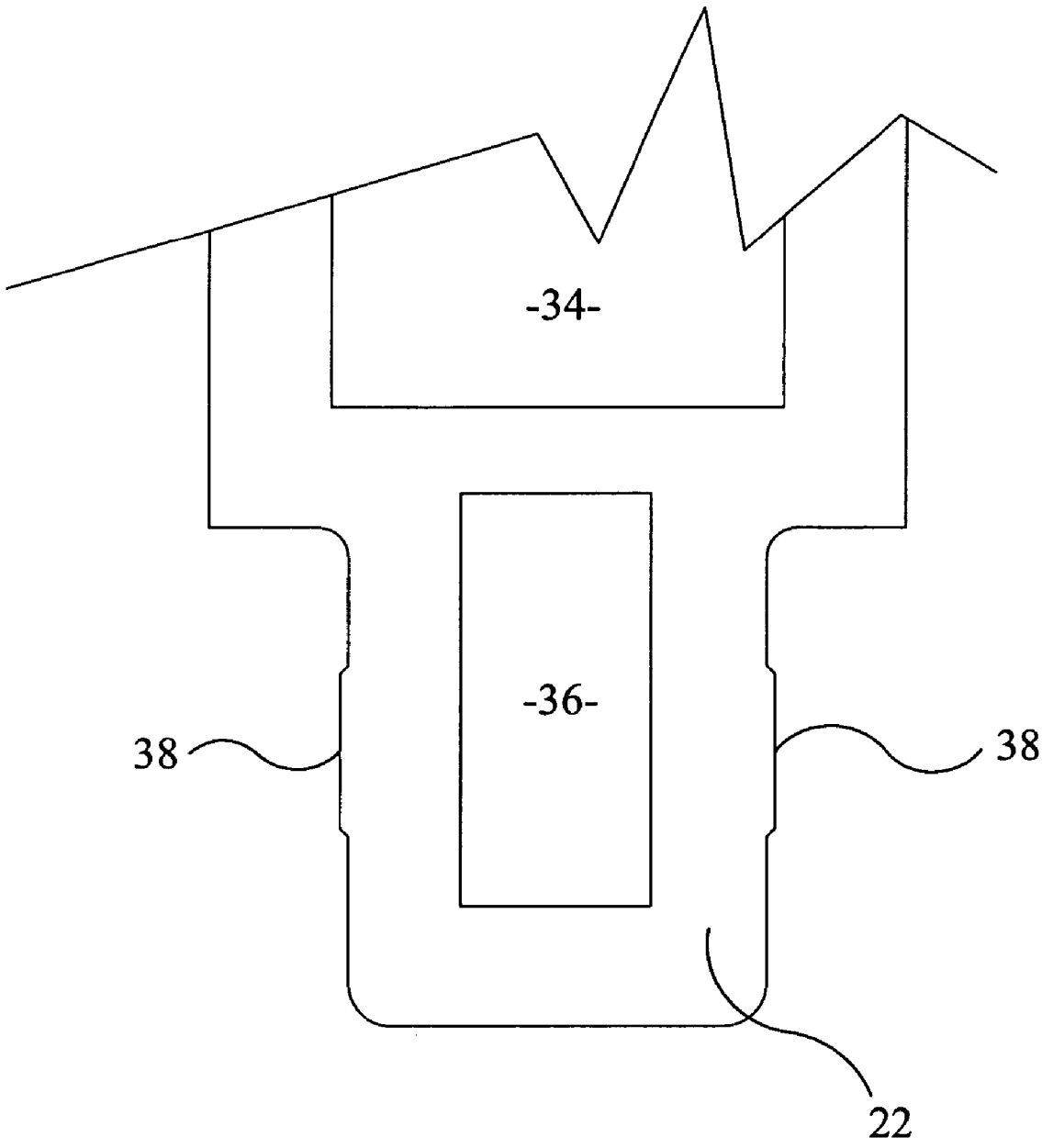
FIG. 3 is an enlarged view of part of a connector used in the frame member of FIG. 1.

As illustrated most clearly in FIG. 3, the connector regions 22 of the connectors 24, 26 are also formed with hollow regions 36. The provision of such hollow regions allows the connector regions 22 to compress, if necessary, during the push-fitting operation thereby accommodating any variations in the widths of the channels 20 which may occur during the extrusion of the first and second frame components 12, 14. Ribs 38 are provided on the connector regions 22, the ribs 38 further serving to accommodate variations in channel width or the like, engagement of the ribs 38 in the channels 20 causing compression of the connector regions as mentioned hereinbefore. Additionally, the provision of the hollow regions 36 in the connector regions 22 allows the connector regions 22 to be used as locations into which screws may be secured during the subsequent assembly operation of a window or door frame using the frame member. By using the hollow regions 36 of the connector regions 22 in this manner, the provision of separate screw locations in the aluminium profiles of the first and second frame components 12, 14 can be avoided and this has manufacturing and cost benefits. The introduction of a screw into the hollow region 36 of the connector region 22 does not significantly impair the thermal insulating properties of the thermal break provided in the frame member 10.

It will be appreciated that the arrangement described herein is merely an example of one embodiment of the invention and that a range of modifications or alterations may be made thereto without departing from the scope of the invention.

The invention claimed is:

1. An insulating frame member comprising first and second frame components interconnected by first and second thermally insulating connectors, each insulating connector being push-fitted to the first and second frame components in a push-fitting direction common to the push-fitting of both of the insulating connectors to both of the frame components, each said insulating connector defining, with the first and second frame components, a channel containing a resin material, the insulating connectors being off-set from one another in the push-fitting direction.

2. The member according to claim 1 wherein each connector includes a pair of push-fit connector regions adapted to be push-fitted into corresponding recesses formed in the frame components, the connector regions being hollow and defining locations into which screws can be secured.

3. The member according to claim 2, wherein each push-fit connector region is of hollow form.

4. The member according to claim 3, wherein each push-fit connector region defines a locator opening into which a screw is receivable.

5. The insulating frame member according to claim 2, wherein each push-fit connector region is provided with ribs.

6. The member according to claim 1, wherein each insulating connector includes a hollow region.

* * * * *